United States Patent [19]

Cole, Jr.

[11] Patent Number: 4,975,812

[45] Date of Patent: Dec. 4, 1990

[54] INDIRECT LIGHTING FIXTURE

[75] Inventor: John M. Cole, Jr., Hingham, Mass.

[73] Assignee: Litecontrol, Hanson, Mass.

[21] Appl. No.: 206,522

[22] Filed: Jun. 14, 1988

Related U.S. Application Data

[62] Division of Ser. No. 45,292, May 4, 1987, Pat. No. 4,760,505.

[51] Int. Cl.[5] ..... F21S 3/00

[52] U.S. Cl. ..... 362/225; 362/346; 362/241; 362/260

[58] Field of Search ..... 362/217, 260, 241, 247, 362/147, 346, 225, 296, 297, 298

[56] References Cited

U.S. PATENT DOCUMENTS

| | | | |
|---|---|---|---|
| 2,240,179 | 4/1941 | Doane | 362/225 |
| 2,878,369 | 3/1959 | Rijnders | 362/217 |
| 3,591,798 | 7/1971 | Florence | 362/225 |
| 3,763,348 | 10/1973 | Costello | 362/217 |
| 4,562,517 | 12/1985 | Pankin | 362/217 |
| 4,748,547 | 5/1988 | Baker | 362/217 |
| 4,760,505 | 7/1988 | Cole, Jr. | 362/225 |

FOREIGN PATENT DOCUMENTS

| | | | |
|---|---|---|---|
| 1066156 | 10/1959 | Fed. Rep. of Germany | 362/225 |

*Primary Examiner*—Ira S. Lazarus
*Assistant Examiner*—D. M. Cox
*Attorney, Agent, or Firm*—Hale and Dorr

[57] ABSTRACT

An indirect fluorescent luminaire with planar specular reflectors arranged in such a manner as to project its maximum intensity approximately at 130° above nadir to optimize the uniformity of ceiling luminance. The lamps are stacked vertically to further minimize the vertical projection of intensity and enhance the lateral projection. The fixture may be suspended at distances of 12 inches or less from the ceiling without causing excessive luminance on the ceiling above the luminaire or excessive luminance ratios between the brightest area directly over the fixture and a point midway between them.

11 Claims, 2 Drawing Sheets

PRIOR ART

INDIRECT LIGHTING FIXTURE

CROSS-REFERENCE TO RELATED APPLICATION

This application is a division of U.S. Pat. application Ser. No. 07/45,292, filed May 4, 1987, and now U.S. Pat. No. 4,760,505, issued July 26, 1988.

BACKGROUND OF THE INVENTION

Fluorescent lighting fixtures are in widespread use for providing illumination and have gained great acceptance because of the reduced cost of operation compared with the lumen output of comparable incandescent fixtures. There are, however, many shortcomings in the existing fixtures mainly because of their inefficient use of the available light. For example, it is rather common to utilize a translucent cover over the fixture which, in some instances, tends to disperse the light more evenly in the area illuminated but decreases the lumen output. A further deficiency is found in the manner in which the housings are constructed. The housings, for example, are merely rectangular boxes painted white to reflect some of the light back out into the room, which structure is inefficient.

In the past, there have been some attempts at arranging fluorescent lamps in vertical alignment as, for example, in the Florence Pat., U.S. No. 3,591,798 and the Doane Pat., U.S. No. 2,240,179. There has also been some activity at developing in direct lighting fixtures as seen, for example, in the Lewin Pat. U.S. No. 4,388,675 where a plurality of inverted V-channels are positioned behind fluorescent tubes in the fixture. While the prior art patents do offer some interesting approaches with respect to particular situations, none of them individually or in combination disclose or suggest the invention defined by the appended claims.

SUMMARY

An indirect multiple, vertically stacked tube luminaire in a rectangular housing has planar specular reflectors that extend parallel to the tubes and project the light energy at a low angle to achieve an even spread of light over the ceiling. The reflectors are V-shaped and are at an angle so that the light energy for the bottom tube is reflected above the top tube and the light energy from the top tube is directed above itself. This arrangement maximizes the uniformity of ceiling luminance. The resulting fixture efficiency is 89% or higher.

One of the objects of the instant invention to provide a lighting fixture which may be readily fabricated at relatively low cost which will be thinner than existing lighting fixtures and will use standard available one inch diameter fluorescent lamps, the fixture controlling the light emitted therefrom in such a manner that the available illumination is emitted at a low angle.

It is also a general object of the invention to provide a lighting fixture which has two elongated juxtaposed fluorescent lamps that extend parallel to each other in vertical alignment and which are associated with specular reflectors arranged in the fixture so as to emit light at a low angle.

DESCRIPTION OF THE PREFERRED EMBODIMENT

Figure 1:
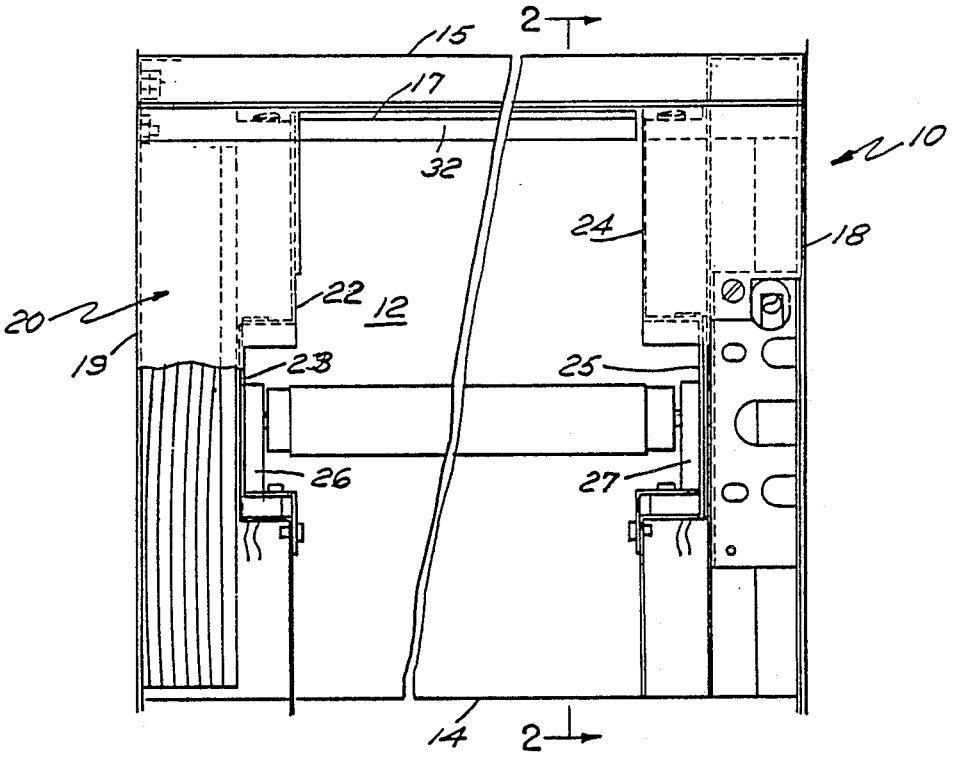
FIG. 1 is a top view of a lighting fixture made in accordance with the invention.

Referring to the drawings, there is illustrated a generally shallow rectangular fixture housing 10 which has flat bottom wall 12 with rising side walls 14, 15. By referring to FIG. 2, it will be seen that the side walls 14 and 15 each terminate in an inwardly bent downwardly directed portion 16 and 17. The fixture is also provided with end walls 18, 19. A ballast compartment generally designated 20 is provided and a pair of inner end walls 22, 24 each have recesses 23, 25 and into these recessed sections are fitted sockets 26, 27 to receive the fluorescent tube. The fluorescent tubes may be of a standard type and are typically 48 inches long although other lengths may be utilized and are commercially available. It will also be noted by referring to the drawing, that the ballast is located in the end of the fixture on its side and transversely to the fixture. In this fashion there is no more than three inches between the end of the socket and the end wall of the fixture. When a plurality of fixtures are mounted end to end, there will be therefore, no more than six inches between the ends of the tube sockets.

Figure 2:
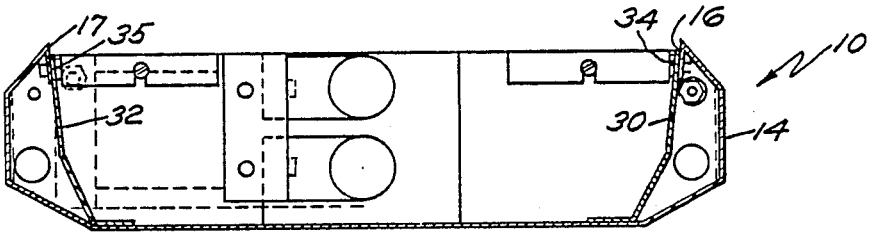
FIG. 2 is a sectional view taken on lines 2–2 of FIG. 1.

Referring specifically to FIG. 2, it will be seen that there are V-shaped side reflectors 30 and 32 which are affixed to the inturned side wall portions 16 and 17, respectively. The upper portion of the reflector is set at an angle to reflect the incident light from the upper lamp in the lowest possible path while the lower portion of the reflector is set to receive the incident ray from the lower lamp in a slightly higher path. By way of example, the upper portion of the reflector is 7° from the vertical, while the lower portion of the reflector is 24° from the vertical. These angles will be valid when the reflector meets the bottom wall 12 and it is approximately 4 inches from the center line of the lamps. The reflector should be a specular reflector and may be of a structure such as is known and sold under the trademark "Alzak". As will be noted, the reflectors 30 and 32 are fastened to the inturned side walls by screws 34, 35.

Figure 3:
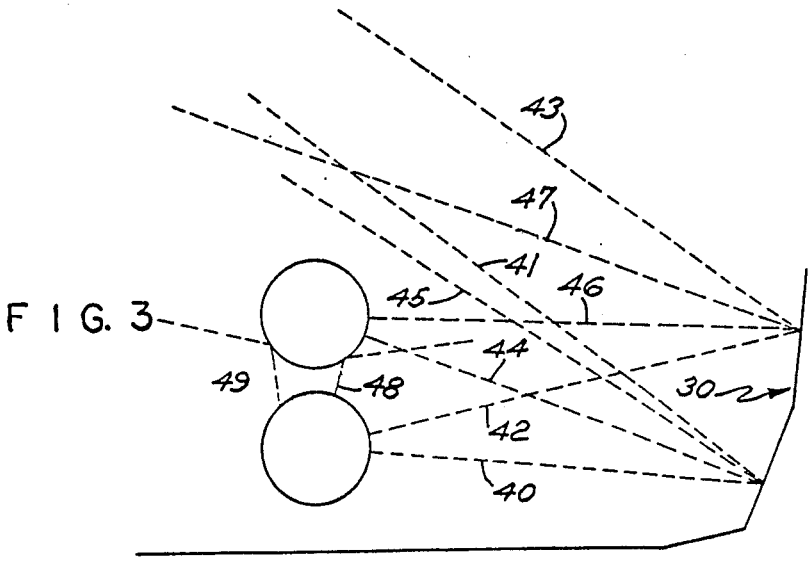
FIG. 3 is a ray diagram of the invention.

Referring now more particularly to FIG. 3, it will be seen that the lower lamp will emit a ray such as 40 which is reflected as a ray 41; similarly a ray 42 from the lower lamp will be reflected by the upper reflector as a ray 43. The upper lamp will have a ray such as 44 that impinges on the lower reflector which will then reflect as a ray 45; similarly, a ray such as 46 from the upper lamp hits the upper reflector and will be reflected off as a ray 47. In addition, the upper lamp redirects the upward light as shown by rays 48, 49. Thus only the flux from the upper lamp is directed toward the ceiling.

Figure 4:
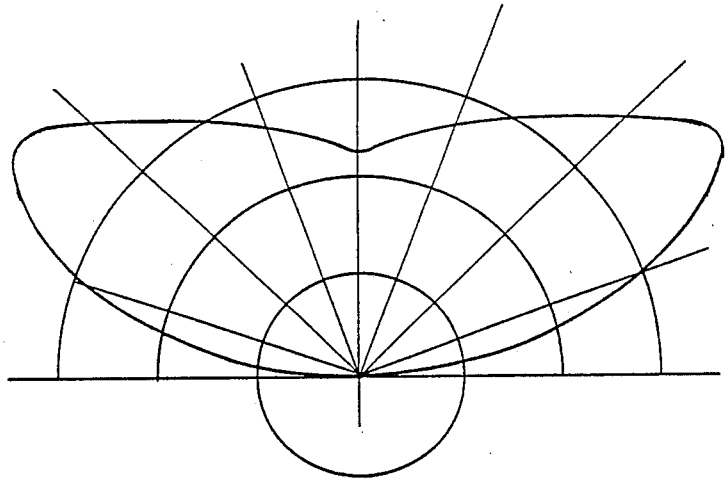
FIG. 4 illustrates the light distribution pattern of the invention.

In essence, the upper reflector is set at an angle to reflect the incident ray of light from the upper lamp in its lowest possible path which does not intercept the upper lamp. Consequently, the incident ray from the lower lamp is reflected in a slightly higher path. To this end, the lower reflector is set at an angle to reflect light of the incident ray from the upper lamp along a path does not intercept either one of the lamps. Noting, for example, in FIG. 4, which illustrates the intensity distribution diagram. The intensity at the zenith is relatively low compared to the maximum intensity which occurs at about 130°. This is advantageous since it is not desired to have any form of a hot spot directly above the fixture.

Figure 5:
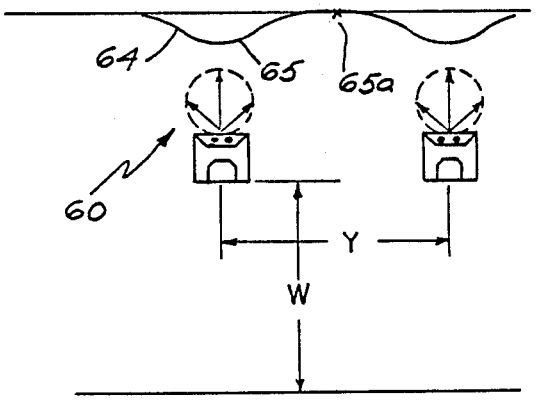
FIG. 5 illustrates a comparison of existing prior art fixtures with the fixtures of the instant invention.
Figure 5:
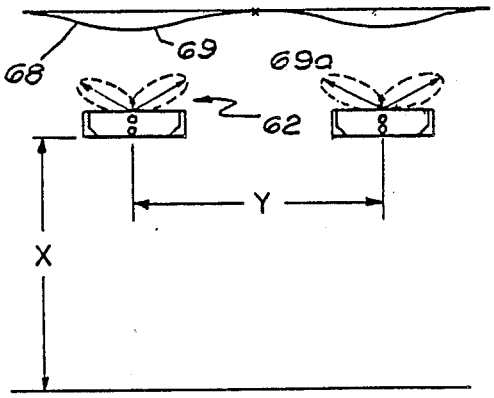

FIG. 5 shows a comparison between the cosine distribution, as indicated generally at 60, which is characteristic of a traditional fixture and the widespread distribution generally indicated 62 that is available with the instant invention. As a further comparison, the line 64 is plot of luminance of the ceiling over a traditional fixture showing that the luminance is much more pronounced at the point 65 directly over a fixture than at the midpoint, such as 65*a*. Typically, the ratio of the values at point 65 to point 65*a* is excessive with a traditional fixture, that is usually hung about 12 inches below the ceiling. Line 68 is a plot luminance of the ceiling with the fixture of the instant invention hung about 9" below the ceiling showing that the luminance is only slightly more pronounced at the point 69, directly over the fixture than at the midpoint 69*a*. The ratio of the values between 69 and 69*a* is more acceptable when the fixture of the invention is hung twelve inches or more below the ceiling.

Essentially, what has been achieved here is that instead of the bright area directly above the fluorescent luminaire, the brightness on the ceiling has been minimized directly over the fixture. Also, in the current practice, fixtures are generally six inches deep and, when the fixture is suspended approximately 12 inches, the whole assembly extends 18 inches from the ceiling. Current construction practice commonly employ ceiling heights of 8 ½ feet, and, therefore, the bottom of the fixture may be 7 feet above the floor. This creates not only a visually undesirable situation but it also is perceived as a threat to tall people. The instant invention lessens the brightness areas of the ceiling by widening the distribution pattern of light and thus permits a shorter stem. The fixture is made shallow by placing the ballast in line with the lamp rather than below the lamp. The beneficial result changes the stem length from 14 inches to 9 inches and the fixture height from 6 inches to 3 inches. Clearance above the finished floor is now 7 foot 6 inches, accomplished with a fixture that is 89% efficient.

I claim:

1. An indirect fluorescent multiple tube light fixture for mounting a distance below a ceiling surface comprising an elongated rectangular housing having a flat bottom wall, linear fluorescent tubes mounted one above the other to define a lower tube and an upper tube, and elongated side reflectors arranged parallel to the tubes, an upper reflecting surface portion of each of said side reflectors being positioned above and at an angle closer to the vertical than a lower elongated reflecting surface portion of the side reflector, the upper and lower reflecting surface portions each being arranged to reflect light energy from the lower tube at a respective angle such that the reflected light energy will pass above the upper tube at a low angle to the horizontal, and the lower reflecting surface portion being below said upper tube and being arranged to reflect light energy from the upper tube at an angle such that the reflected light energy will pass above the upper tube at a low angle to the horizontal.

2. A fixture as in claim 1 wherein the upper elongated reflecting portion is arranged to reflect light energy from the upper tube at an angle such that the reflected light energy from the upper tube will pass above the upper tube at a low angle to the horizontal.

3. A fixture as in claim 1 wherein the elongated reflecting portions are each arranged such that light energy from the upper tube reflected by the respective reflecting portion passes above the upper tube at a lower angle to the horizontal than does light energy from the lower tube reflected by the respective reflecting portion.

4. A fixture as in claim 1 wherein the side reflectors have specular surfaces and the bottom wall is matte white, the bottom wall being arranged to reflect a portion of the flux from the lower tube.

5. A fixture as in claim 1 wherein the ballast is located adjacent to one end of said tubes and is oriented transversely to the tubes with its thinnest dimension perpendicular to the tubes.

6. A fixture as in claim 1 wherein first and second side walls extend in a general vertical direction from the bottom wall and have an inturned upper portion that supports the reflector.

7. A fixture as in claim 1 wherein the housing has a pair of end walls and the ballast has width and height dimensions the shortest of these being between the end of the tubes and an end wall.

8. A fixture as in claim 1 wherein the lamps are mounted one above another whereby the upper lamp redirects the upward flux from the lower lamp so that only flux from the upper lamp is emitted upward.

9. An indirect fluorescent multiple tube light fixture for mounting a distance below a ceiling surface comprising an elongated rectangular housing having a flat bottom wall, linear fluorescent tubes mounted one above the other to define a lower tube and an upper tube, and elongated side reflectors arranged parallel to the tubes, an upper reflecting surface portion of each of said side reflectors being positioned above and at an angle closer to the vertical than a lower elongated reflecting surface portion of the side reflector, and the upper and lower reflecting surface portions each being arranged to reflect light energy from the lower tube at a respective angle such that the reflected light energy will pass above the upper tube at a low angle to the horizontal, said lower reflecting surface portion being arranged such that light of the incident ray from said upper tube reflected by said lower reflecting surface portion does not intercept either said upper tube or said lower tube.

10. An indirect fluorescent light fixture for mounting a distance below a ceiling surface comprising:

an elongated housing having a flat bottom wall;

two linear fluorescent tubes mounted one above the other to define a lower tube and an upper tube; and, elongated side reflectors arranged parallel to and on opposite sides of said tubes, each of said side reflectors including a lower elongated reflecting surface portion and an upper elongated reflecting surface portion positioned above and at an angle closer to the vertical than the lower side portion, said tubes and said reflectors being arranged such that light energy from the incident rays from lower tube reflected from said upper and lower reflecting surface portions will pass above the upper tube at a low angle to the horizontal, light energy from the incident ray of upper tube reflected from said upper and lower reflecting surface portions will pass above the upper tube at a lower angle to the horizontal then does light energy from the lower tube reflected by the respective reflecting portion, and light energy from the incident ray from the upper tube reflected by the lower reflecting surface portion does not intercept either the upper tube or the lower tube.

11. An indirect fluorescent multiple tube light fixture for mounting a distance below a ceiling surface comprising an elongated rectangular housing having a flat bottom wall, linear fluorescent tubes mounted one above the other to define a lower tube and an upper tube, and elongated side reflectors arranged parallel to the tubes, an upper reflecting surface portion of each of said side reflectors being positioned above and at an angle closer to the vertical than a lower elongated reflecting surface portion of the side reflector, the lower reflecting surface portion being positioned below the upper tube and being arranged to reflect light energy from the upper tube at an angle such that the reflected light energy will pass above the upper tube at a low angle to the horizontal and such that light of the incident ray from said upper tube reflected by said lower reflecting surface portion does not intercept either said upper tube or said lower tube.

* * * * *